United States Patent [19]

Mank et al.

[11] Patent Number: 4,742,792

[45] Date of Patent: May 10, 1988

[54] COMMUNICATION ARRANGEMENT BETWEEN A SUB-SEA STRUCTURE AND FLOATING VESSEL

[75] Inventors: James L. Mank, High Wycombe, England; Bryson Riddler, Aberdeen, Scotland

[73] Assignee: Ferranti Subsea Systems Limited, Edinburgh, Scotland

[21] Appl. No.: 884,596

[22] Filed: Jul. 11, 1986

[30] Foreign Application Priority Data

Jul. 19, 1985 [GB] United Kingdom ..... 8518221

[51] Int. Cl.[4] ..... B63B 35/00

[52] U.S. Cl. ..... 114/264; 114/270; 285/1; 285/2; 285/119

[58] Field of Search ..... 114/230, 247, 259, 264, 114/312, 313, 327, 328, 337, 270; 242/54 R; 441/3-5; 285/1, 2, 119, 34; 405/191, 158, 160; 141/387; 175/7, 27; 166/352, 338, 355, 339, 363, 365, 340

[56] References Cited

U.S. PATENT DOCUMENTS

| | | | |
|---|---|---|---|
| 3,381,485 | 5/1968 | Crooks et al. | 405/191 |
| 3,596,070 | 7/1971 | McCool | 114/247 |
| 3,605,668 | 9/1971 | Morgan | 175/7 |
| 3,742,536 | 7/1973 | Sada et al. | 114/230 |
| 4,077,472 | 3/1978 | Gano | 166/359 |
| 4,134,634 | 1/1979 | Baur et al. | 114/247 |

*Primary Examiner*—Joseph F. Peters, Jr.
*Assistant Examiner*—Edwin L. Swinehart
*Attorney, Agent, or Firm*—Kerkam, Stowell, Kondracki & Clarke

[57] ABSTRACT

A communication arrangement between a sub-sea structure and a surface vessel is by a flexible control umbilical deployed from the vessel in such a way as to accommodate relative movement between the structure and vessel. Unpredictably excessive movements can risk breakage of the umbilical, causing damage to equipment controlled by it and 'down-time' while the equipment is repaired and the umbilical replaced. In the present invention (FIG. 2) the umbilical 13 is suspended from a reel 20 of deployment means 14, which is braked to resist motion below a predetermined level of umbilical tension but above that level the braking is overcome enabling the deployed umbilical to draw off, and deploy, a further length 13' while the communication channels of the umbilical are shut-down, including powering-down any sub-sea equipment in controlled manner. If, subsequently, the further length of umbilical is all deployed, or optionally, the umbilical tension exceeds a second predetermined tension, umbilical coupling means 28, at which the umbilical is coupled to the vessel system, is released at the coupling point to fall into the sea to be recovered and re-coupled when conditions permit.

19 Claims, 4 Drawing Sheets

Figure 3:
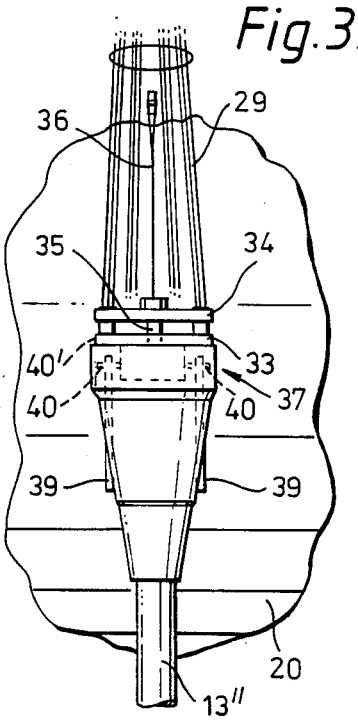

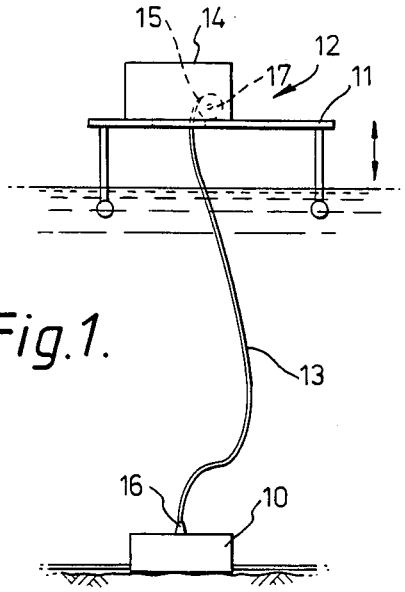
Fig.1.
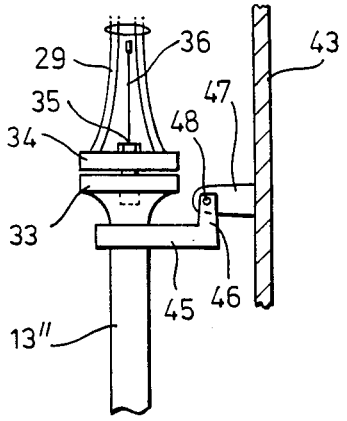
Fig.7.
Fig.2.
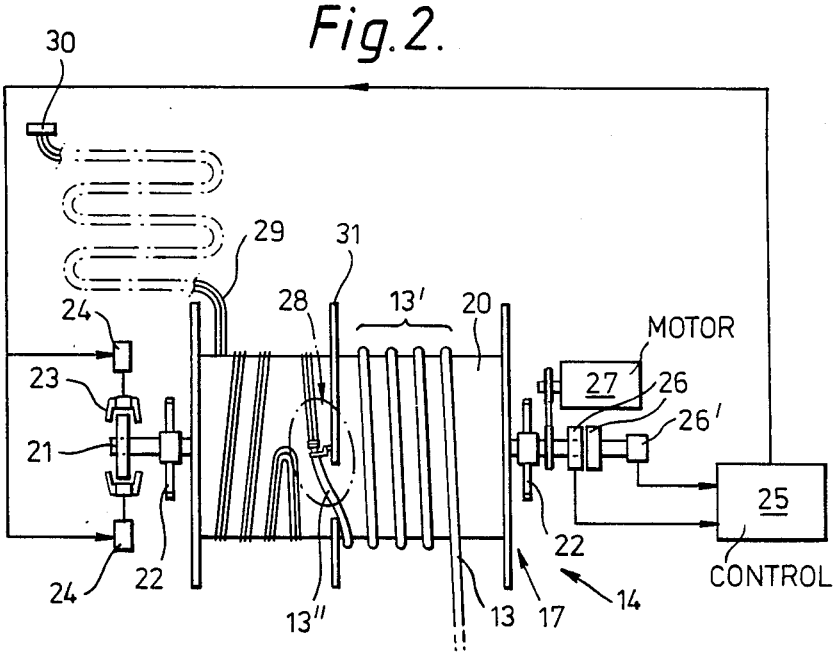

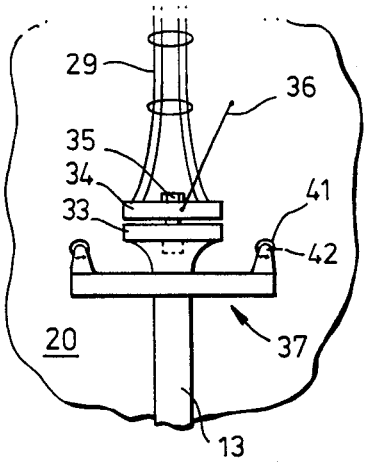
Fig. 6(a).
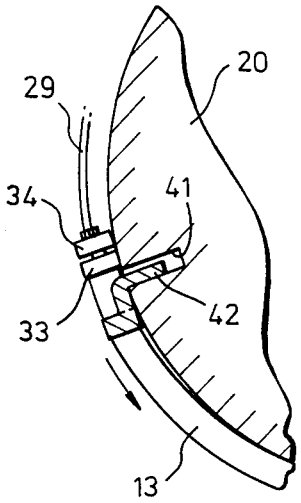
Fig. 6(b).
Fig. 8.
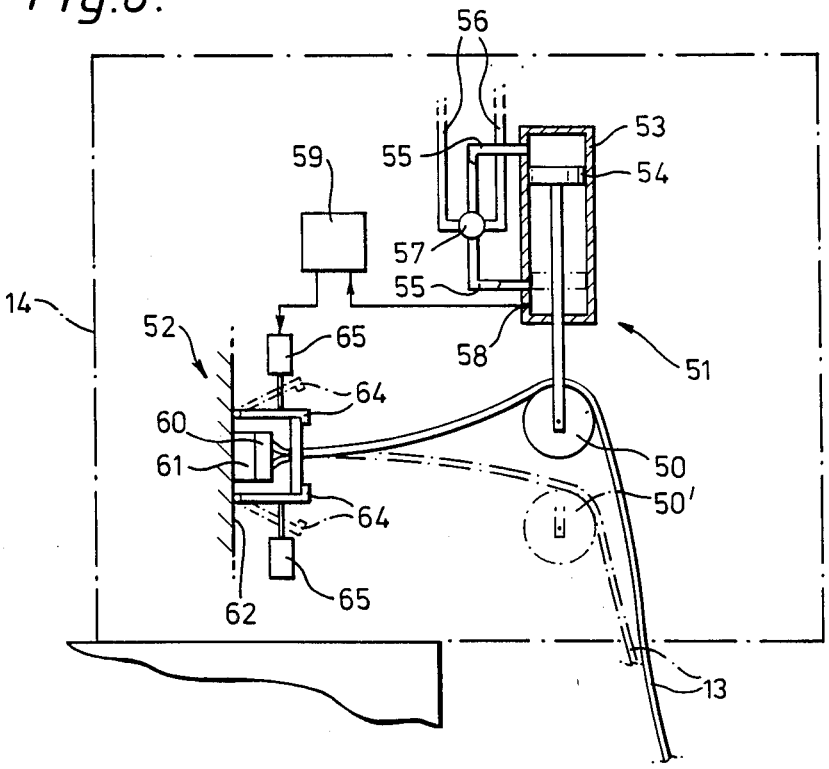

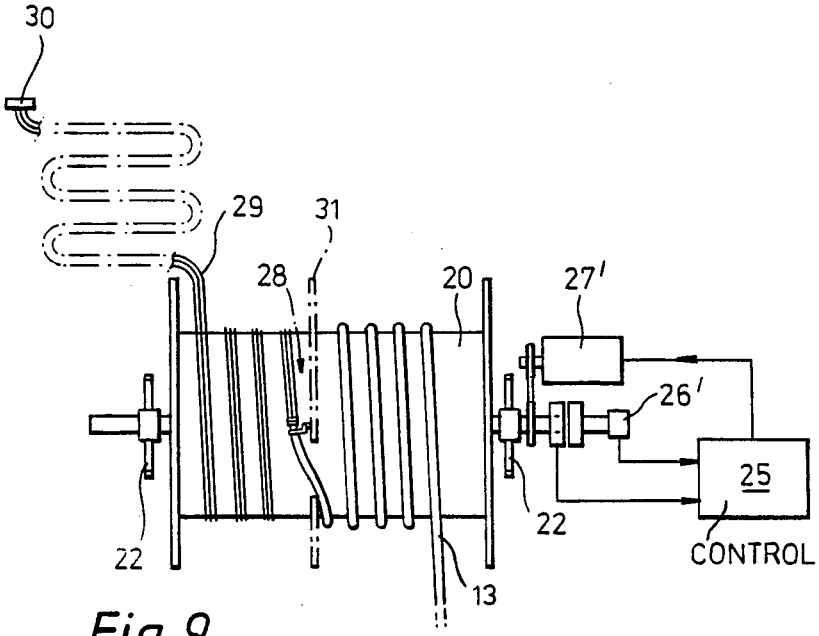
Fig. 9.
Fig. 10.
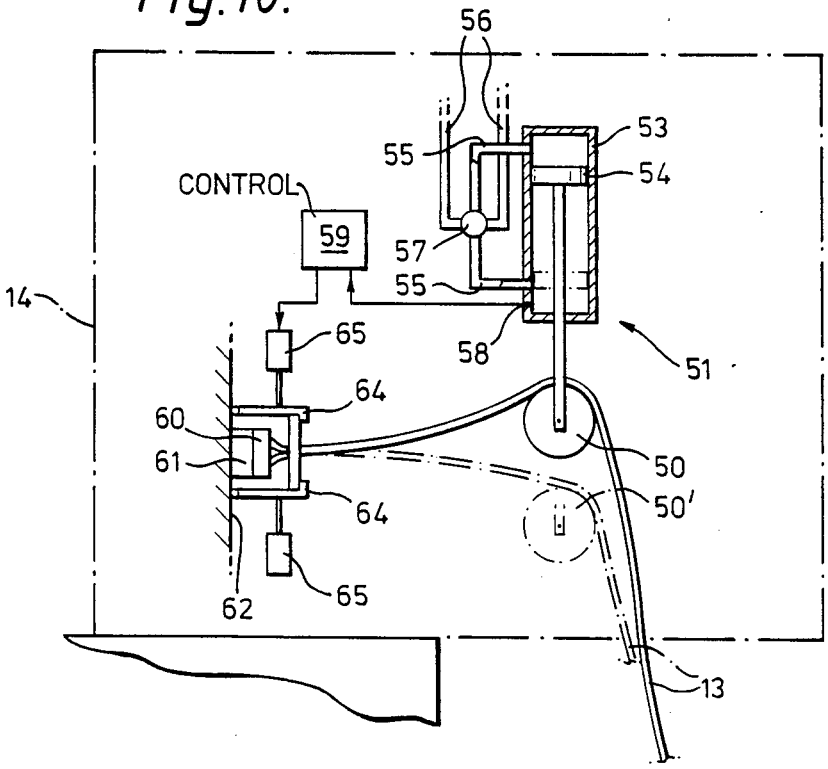

COMMUNICATION ARRANGEMENT BETWEEN A SUB-SEA STRUCTURE AND FLOATING VESSEL

This invention relates to connection arrangements and in particular to arrangements for communicating between a sub-sea structure and a floating vessel.

The term "communication" is employed in this specification to include the passage of electrical or optical signals by way of cable and the passage of fluids by a way of hollow members. In this latter respect it is intended to include the passage of control fluids, such as pressurised hydraulic or pneumatic fluids and the passage of bulk fluids, such as oil or gas produced by a sub-sea well to which the structure is attached.

With this in mind a communication member may be perceived to include any elongate flexible member having one or more communication channels, which channels may be fluid passageways or signal cables. A production riser may have a single fluid passageway whereas a structure control umbilical may comprise a mixture of different types of communication channels.

Irrespective of the construction of the communication member there are several criteria governing operation of the communications arrangement.

Firstly it must accommodate relative motion between the floating vessel and the sub-sea structure and secondly it must be disconnectable in an emergency should the displacement of the relative motion unpredictably exceed a tolerable value or should the communication member become fouled by some other moving vessel or its equipment.

Such disconnection must be capable of being effected automatically and before damage is done to the member itself and it is an object of the present invention to provide a communication arrangement which enables such automatic disconnection.

According to the present invention a communication arrangement between a sub-sea structure and a floating vessel, comprises an elongate flexible communication member having at least one communication channel, deployment means on the vessel operable to deploy the flexible communication member by suspending it from support means movable with respect to the deployment means to determine the length of flexible member deployed, releasable coupling means arranged to couple each communication channel of the flexible communication member to a corresponding channel of a vessel communication system and control means responsive to a predetermined level of tension in the suspended flexible communication member to deploy a further length of the member and to inhibit communication between the channels of the vessel system and the channels of the flexible communication member and responsive to continuation of said tension in the flexible communication member of at least said predetermined level after deployment of said further length of the member to uncouple the flexible communication member from the vessel system at said coupling means and release the flexible communication member from the deployment means.

Figure 4:
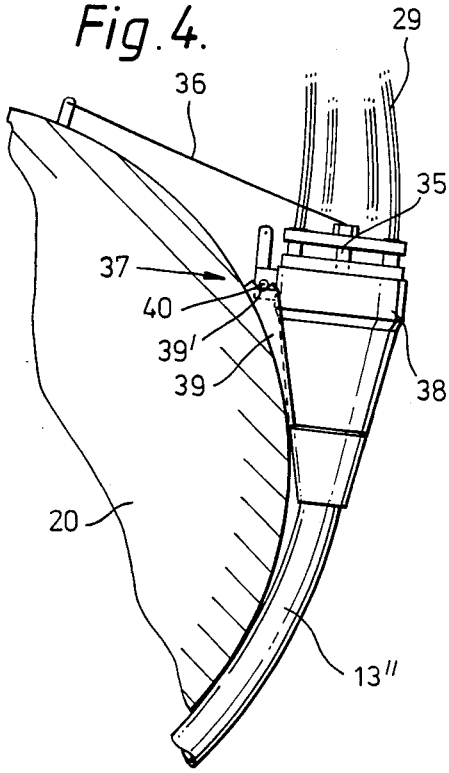
Figure 5:
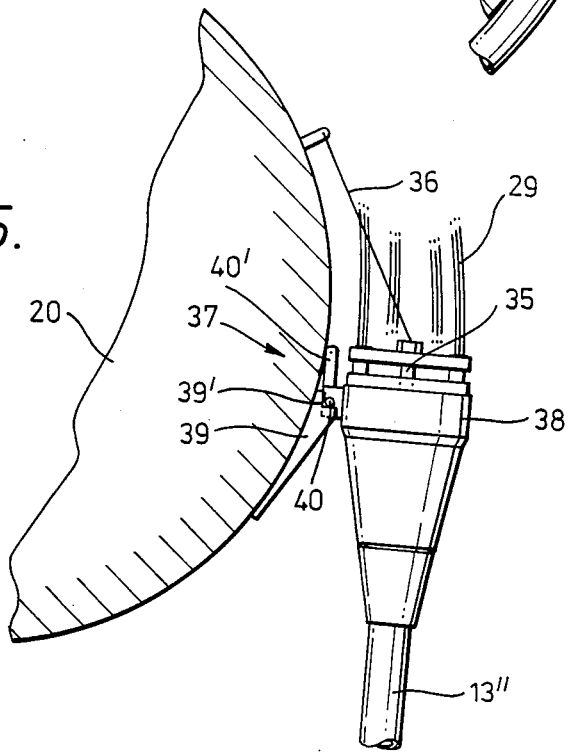

Embodiments of the present invention will now be described with reference to the accompanying drawings, in which:

FIG. 1 is a sectional elevation through an arrangement of the present invention showing the large scale items of the system indicating the location of deployment means, FIG. 2 is a plan view of the deployment means, showing a flexible communication member wound on support means in the form of a reel, FIG. 3 is a plan view of the detail of encircled region 3 of the support reel of FIG. 2, illustrating one form of mounting means by which the flexible communication member is secured to the reel, FIG. 4 is an elevation view of the mounting means of FIG. 3 illustrating the engagement means with the flexible communication member would on the reel, FIG. 5 is a sectional elevation, similar to FIG. 4 but illustrating the mounting means when the flexible communication member has become unwound from the reel, FIGS. 6(*a*) and 6(*b*) are plan and elevation views of an alternative form of mounting means having different engagement means, FIG. 7 is a plan view of yet another form of mounting means, FIG. 8 is a sectional elevation of an alternative form of deployment means applicable to the present invention, FIG. 9 is a plan view of an arrangement similar to FIG. 2 but showing the deployment means operable in a constant-tension mode, and FIG. 10 is a sectional elevation similar to FIG. 8 but also showing the deployment means operable in a constant-tension mode.

Referring to FIG. 1, a sub-sea structure 10 and a floating vessel 11 are coupled by a communication arrangement 12 comprising an elongate flexible communication member 13, having at least one communication channel, communicating between corresponding channels on the structure and a vessel system. In this embodiment the flexible communication member is a control umbilical and the communication channels comprise electrical conductors for the transmission of control and telemetry signals and hydraulic hoses supplying actuating power to undefined equipment (not shown) in the sub-sea structure 10. The deployed umbilical although flexible is protected by an armoured sheath.

The vessel 11 carries deployment equipment 14 which is operable to deploy the umbilical by suspending it from an upper point 15 to hang under its own weight for connection to the sub-sea structure at a lower point 16.

The deployment equipment 14 includes support means 17 which is operable to suspend a deployed length of umbilical in excess of the operational separation between the deployment means 14 and the sub-sea structure. In normal operation the support means 17 is fixed in position with respect to the vessel and umbilical whereby sea-induced variations in the separation between the deployment means 14 and the structure 10 are accommodated by the excess length of umbilical deployed.

The deployment means is shown in somewhat greater detail in the plan view of FIG. 2.

The support means 17 for the umbilical 13 comprises a reel 20 having an axle 21 rotationally mounted by means of axle supports 22 at a fixed location on the vessel and upon which an undeployed length of umbilical 13′ is wound. It will be seen that an upper point of the suspended deployed umbilical is supported where it makes tangential contact with the reel surface and the tension at the upper point is manifested as the rotational torque exerted on the reel about the axle 21. The reel includes braking means 23, which is biased into a braking condition, that is, normally fixing the rotational position of the drum. The braking means 23 is biased into the braking condition, for example, by a preset bias spring arrangement which prevents rotation of the drum until a corresponding predetermined torque level is applied, above which level the drum slips with respect to the braking means. Actuation means 24, which with the braking means forms part of a larger control means shown generally at 25, is arranged to release the braking means when making intentional positional changes of the drum. The axle 21 also carries reel position measuring means 26 which determines the absolute rotational position of the reel in relation to the length of umbilical wound thereon.

A drive motor 27 is coupled to the axle so as to rotate the reel with the braking means released for winching-in the deployed umbilical, for instance when the vessel is relocated, the reel being a convenient storage arrangement, and for deploying, or redeploying, a fixed length at a new location.

The end of the umbilical 13'' is connected by releasable coupling means 28, shown in greater detail with reference to FIG. 3, to a communication system of the vessel. The vessel communication system comprises a flexible jumper communication umbilical 29 which extends between a fixed coupling 30 on the vessel structure and is arranged to be wound on to a portion of the reel which may be separated by a flange. To avoid confusion the jumper umbilical will hereinafter be referred to as the jumper. The jumper, whilst corresponding to the umbilical in terms of communication channels, is not required to be armoured and is preferably made more flexible and smaller than the umbilical and more easily handled. The jumper may be wound on the reel in the opposite sense to the umbilical 13, as shown, such that when the umbilical is wound onto or off the reel so is a corresponding length of the jumper. Alternatively, the jumper may be wound in the same sense as the umbilical 13, that is as a continuation thereof, such that as umbilical is deployed by rotation of the reel in one sense a corresponding length of the jumper is wound onto the reel to replace it.

The coupling means 28 includes a pair of coupling members (33, 34 FIG. 3) attached one each to the end 13'' of the umbilical and the jumper 29 to terminate each communication channel therein and to cooperate with each other to connect each said communication channel between the jumper and the umbilical.

Considering an overall view of operation, a predetermined length of umbilical is deployed having regard to expected sea-induced motions of the vessel and the tensions expected to be introduced in the umbilical by the deployed weight and any other forces expected to act thereon, the braking means 23 is applied and the reel 20 fixed in rotational position.

If the tension in the deployed umbilical exceeds a predetermined level, with the risk of breaking of the umbilical or damage to other equipment, such as mounting points of the deployment means, torque exerted on the reel by the tensioned umbilical overcomes the braking force and causes the reel to rotate permitting the undeployed length 13' to be drawn off the reel for as long as this tension exceeds the predetermined level to which the braking means is set and mitigates any significant increase in umbilical tension beyond the level. As the reel rotates and the previously undeployed length is deployed a corresponding length of the jumper 29 is wound off the reel.

During the time that the portion 13' is being deployed the reel 20 of the support means moves in rotation about axle and position transducer means 26 determines the rotational position of the reel at which a predetermined length of umbilical remains undeployed, for example when a known number of wraps of the umbilical around the reel is reached.

When such a position of the reel 20 is reached the control means sends instructions to the vessel management system (not shown) which inhibits the communication channels between the vessel and sub-sea stations, that is, sends shut-down instructions to controlled apparatus on the sub-sea structure and then shuts down any high pressure fluid channels and disconnects electrical power lines at the vessel side of coupling 30.

When the excess length 13' of the umbilical has been deployed, the releasable coupling means is still connecting the end of the umbilical to the jumper 29.

The coupling means as well as coupling members 33, 34 referred to above also comprises a communication mounting member by which the flexible communication member, that is the umbilical, is secured to the reel by engagement means to prevent the transfer of tension in the umbilical to the coupling members. The coupling means, in particular the engagement means is arranged to release the coupling member from the reel when the umbilical is fully unwound from the reel such that the umbilical tension separates the coupling members and enables the umbilical to be drawn from the deployment means and fall therefrom into the sea.

The terminal portion 13' of the umbilical may be caused to pick up a recovery buoy as it falls, in a manner known per se, to aid recovery of the umbilical when the conditions have returned to normal.

The construction of the coupling means and its release may be effected in a number of ways which suggest themselves to one skilled in the art but the arrangement shown in the elevation view of FIG. 3 and sectional elevation views of FIG. 4 represents a particular simple and reliable form of release means with few components.

Referring to FIGS. 3 and 4, which show the encircled region 3 of FIG. 2, the end portion 13'' of the undeployed umbilical portion 13' wound around the surface of reel 20 terminates at the coupling member 33 and meets with coupling member 34 forming a termination of the individual channels of the bundle forming the jumper 29.

The coupling members 33 and 34 comprise stab plates which join the various fluid and electrical channels and are secured to each other by frangible connection means in the form of a shear bolt 35 which is arranged to fracture and permit the coupling members to be separated by the application of a tensile force less than the predetermined level at which the braking means slips. A stay member 36, such as a flexible wire or chain, attaches the coupling member 34 of the jumper umbilical to the reel such that no significant tensile strain is exerted between the member 34 and the jumper umbilical channels when the coupling members are separated.

Mounting means 37 comprises a mounting member 38 clamped onto the umbilical adjacent to the coupling member 33 and is secured to the reel by engagement means to prevent the transmission of tensile forces from the umbilical to the coupling member until necessary.

The engagement means comprises at least one substantially radially extending abutment surface formed by, or on, the reel and cooperating abutment means, formed by, or carried by, the mounting member, operable to abut against the surface and prevent movement between them circumferentially of the reel surface due to the umbilical tension acting on the mounting member.

In FIG. 3 the abutment surface is formed by a pair of shoulder members 39 each raised with respect to the reel surface and having abutment surfaces 39' which, although extending substantially radially of the surface are slightly inclined or curved away from the direction of action of the umbilical tension to form a slight recess in which a toggle pin 40 is located and which is retained by the umbilical tension in the recess, carried by the mounting member 38 and extending longitudinally of the reel.

The mounting member also is provided with a projection 40' which extends longitudinally of the umbilical, that is, perpendicular to the pin and abutment surfaces and circumferentially of the reel.

Referring to FIGS. 4 and 5 it will be appreciated that with the toggle pin 40 in abutment with shoulder 39' and located in the recess tension acting along the umbilical acts on the engagement means tangentially of the reel surface at the abutment point so that the umbilical tension is transformed into a torque acting about the reel axis with little tendency for the toggle pin to move over abutment surface against which it bears.

When the umbilical has become fully unwound from the reel, which is still however rotated by coupling of the umbilical tension through the engagement means, the umbilical and mounting member 38 tend to pivot about the toggle pin 40 as a component of the umbilical tension is caused to act not only tangentially, but also radially of the reel. The radial component is insufficient, at least initially, to move the pin out of the recess up the inclined face 39' of the abutment surface but the projection 40' which engages the reel acts as a cam and causes the toggle pin to leave the abutment surface and disengage the mounting member from the reel.

It will be appreciated that the predetermined umbilical tension level required to overcome the braking force and permit the reel to deploy any further length of umbilical may be exceeded only occasionally such that the further length 13' is unwound at intervals, in response to tension snatches, the brake being reapplied after each snatch. The shear bolt 35 is arranged to break in response to an umbilical tension greater than the weight of the freely deployed umbilical but less than the snatch tension which releases the braking means.

Thus if the mounting member becomes disengaged from the reel after such a snatch the umbilical hangs, by way of the stay member 26 until the next snatch at which point the coupling members 33 and 34 separate. If it becomes disengaged within a longer period of high tension then the coupling will separate immediately upon disengagement.

It will be appreciated that the provision of inclined abutment surface and also the provision of the projection 40' and the camming action to lift it from the abutment surface is optional and reliance may be placed upon the umbilical tension to hold the abutment means to the abutment surface until it is ready to be released and upon the relative positions of reel and mounting member when unwound to release their abutting engagement.

It will be appreciated that other than frangible connection means may be employed to couple the coupling member 33 and 34 provided it enables the members to be pulled apart at an umbilical tension less that said predetermined value.

It will also be appreciated that within the coupling means there are alternative ways of organising the mounting means.

The engagement means may comprise other, equally simple, configurations of abutment surface and abutment means, one of which is shown in FIGS. 6(*a*) and 6(*b*). Those elements which correspond to elements of FIGS. 3 and 4 are given like reference numerals. The engagement means comprises a substantially radially extending pin and recess one each on the reel and a mounting member 38'. As shown the reel contains a radial recess 41 in which a pin 42 of the mounting member locates, although it will be appreciated that the radially extending pin could be formed on the surface of the reel and over which a mounting member, containing a recess for the pin, fits.

The side of the pin abuts the wall of the recess due to the tangential nature of the tension force of the wound umbilical in a manner corresponding to that described above and responds to unwinding of the umbilical, and the radially acting component of umbilical tension it permits, to cause the pin to slide out of the recess and release the coupling means from the reel.

Apart from simple alterations to the arrangements shown in FIGS. 3 to 6, such as in the shape or disposition of the abutment means and abutment surface, such a radially slidable engagement means, which depends essentially on reel position and unwinding of the umbilical, may be replaced by, or combined with, engagement means which depends upon the level of tension in the umbilical.

Referring to FIG. 7 which shows the encircled region 3 of FIG. 2, the two portions of the reel which accommodate the umbilical and jumper are shown separated by flange 43 which is apertured at 44 to permit the end 13'' of the umbilical, including the coupling member 33 to pass through, and meet with, coupling member 34 forming a termination of the individual channels of the bundle forming the jumper 29. A mounting member 45 is attached to the umbilical near the coupling member 33 and includes a mounting arm 46 which extends alongside the umbilical to a lug 47 on flange 43 to which the end of the arm is coupled by means of a frangible connection means in the form of shear pin or bolt 48.

The coupling members 33 and 34 are held together such that the communication channels between the umbilical 13 and jumper 29 communicate, in known manner, by a shear bolt 35 as in FIG. 3, which may be separated by a relatively small axial force or tension, and the coupling member 34 is connected by a flexible stay member 36 as in FIG. 3, to the reel surface.

In normal operation, and when a tension in the deployed umbilical has exceeded said predetermined value, the brake pressure is overcome and enables the umbilical tension to pull further umbilical, wound on the reel from it. As this further length is unwound, giving time for the umbilical communication channels to be shut-down, progressively greater tension is applied to the mounting member 45 but is prevented by the engagement means, that is, shear pin 48 between arm 46 and lug 47, from being transmitted to the coupling members. When the predetermined level of umbilical tension has been exceeded to the extent that the additional length of umbilical has been unwound the end of the umbilical remains secured to the reel by the shear pin 48 of the engagement means.

The shear pin 48 is arranged to fracture at a preset or a second predetermined level of tension in the umbilical as high or higher than said predetermined level at which the braking means releases, so that the coupling will not break before the umbilical is fully unwound. If and when the preset level of tension is reached after the umbilical is unwound the shear pin 48 fractures and the umbilical tension causing the fracture is transmitted to the coupling members 33, 34. The shear bolt 35 therein separates virtually instantaneously and permits the umbilical to fall clear of the reel and the deployment means.

It will be seen that the use of shear pin 48, which may be replaced by any suitable frangible connection means, permits a simple means of both holding the coupling members together in normal operation and providing a readily and accurately determinable umbilical tension in relation to the flange of the reel structure at which the umbilical is uncoupled and released from the deployment means without damage to the coupling members of the coupling means.

The lug 47 and flange 43 may be dispensed with and the frangible connections made between the mounting member and, say, a cooperating recess in the reel surface. Similarly the preset umbilical tension at which the frangible connector fractures may be chosen to take on any value equal to, or preferably in excess of, the predetermined level of umbilical tension at which the control means begins to operate.

It will be appreciated that the engagement means may take other forms than described in order to fulfil the objective of releasing the mounting member after the further length of umbilical has been drawn from the reel of the support means, For instance the frangible connection means described may be replaced by electrically or hydraulically operating latch members or bolts actuated by signals from the control means in response to a determination of said second predetermined level of umbilical tension by measuring the strain between the umbilical mounting member and the reel structure.

Other variations to the contruction outlined may readily be seen. For instance the jumper 29, instead of being a flexible member wound on the reel, may comprise a rigid member fixed in relation to the reel structure, the communication channels thereof being coupled to the remainder of the vessel system by suitably positioned swivel joints and slip rings as appropriate. Similarly, the invention is not limited to the structure of the above described embodiment in which the support means takes the form of a rotatable reel, nor in which the control means functions as described, and other configurations will be described briefly to illustrate the generality of the invention.

FIG. 8, which uses the same reference numbers as FIGS. 1 to 3 where appropriate to indicate identical or corresponding elements, shows deployment means 14 from which a deployed length of control umbilical 13 is suspended the upper-end of the umbilical being supported by a pulley 50 of support means 51 over which it passes and is terminated by coupling means 52 corresponding to the coupling means 28 of FIG. 3.

The support means 51 comprises a hydraulic cylinder 53 containing a piston 54 to which piston the pulley 50 is attached. The cylinder has hydraulic lines, 55 near each end of the cylinder which are connected to a source of hydraulic pressure (not shown) by way of lines 56 or to each other by a valve arrangement 57.

In operation, the valve 57 is configured to institute a fluid lock between the opposite sides of the piston with the piston at the upper end of the cylinder and the support pulley 45 in a fully raised portion, effecting a brake to movement of the pulley 50 of the support means. The downward force exerted on the piston is a measure of the tension in the umbilical and this may be measured by a pressure sensor 58 in the lower part of the cylinder, the signal related to the umbilical tension being fed to control means 59.

The coupling means 52 comprises a coupling member 60 terminating the umbilical communication channels and a cooperating coupling member 61 terminating the corresponding communication channels of the vessel system, which member 61 is fixed in relation to a deployment means structure 62.

The coupling means 52 also comprises an umbilical mounting member 63 secured to the outer sheath of the umbilical and engagement means comprising withdrawable members, such as latch members 64, carried by the structure 62 to hold the coupling members in cooperation. The latch members are movable transversely to the direction of the umbilical tension and withdrawable under the control of actuating means 65 which moves them to the positions shown by dotted lines.

In operation, the position of the support means, pulley 50, is fixed by braking the piston motion by valve 57 with the length of umbilical deployed, as described with reference to FIGS. 1 and 2, greater than the separation between the deployment means and sub-sea structure, relative displacement between them being accompanied by varying tension in the umbilical as measured by the sensor 58.

If a situation causes the cylinder pressure to indicate that the umbilical tension has exceeded a predetermined safe value preventing any increase in the hydraulic pressure supporting the piston and in fact permitting the piston to be drawn down and deploy more umbilical in the same manner as the reel 12 described above.

As this extra umbilical is deployed the control means initiates the communication channels shut-down procedure described above. When the piston is fully extended, the pulley position in relation to the deployment means, and/or any further increase of umbilical tension to the second predetermined level is determined.

The pressure sensor 53 is located beyond the opening of line 48 such that fluid in a small volume of cylinder is subject to the pressure on the umbilical support. If and when this pressure exceeds the predetermined level or a higher preset level the control means signals actuators 65 which withdraw and release latch members 64, the tension in the umbilical separating the coupling members and causing the unrestrained end of the umbilical to pass over the support pulley and drop into the sea.

The above described arrangement illustrates a form of release means which is actuated in response to a remote measurement of umbilical tension and could take any form of withdrawable member, such as a sliding bolt but it will be appreciated that the release means could readily include frangible connection means (such as the shear pin of FIG. 7) which responds directly to the umbilical tension acting through the mounting member 63 or other engagement means analogous to the peg and recess of FIG. 3 which disengages upon displacement of the pulley 50. Similarly, it will be appreciated that the displaceable piston may be replaced by other form of pulley support system, such as a conventional winched cable arrangement, suitable provision being made to measure the cable tension as a function of the umbilical tension.

Other variations are possible in respect of any one of the above embodiments. For instance, the withdrawal means could be caused to provide a withdrawing tension in the umbilicial which increases progressively from the predetermined to preset levels in accordance with the distance moved by the support means, that is reel rotation or piston displacement, as the further length of umbilical is unwound. Alternatively, the withdrawal means may be dispensed with such that once the predetermined level of umbilical tension has been reached and the brake released the support means reel is free to move and deploy the further length of umbilical without resistance to the motion.

The above described embodiments have related to a flexible communication member, a control umbilical, deployed in the so-called free suspension mode wherein, in normal operation, a fixed length is deployed and the supported flexible communication member does not move in relation to the deployment means.

Where the constraints of maintaining communication are satisfied for lower amplitudes of such relative displacement the flexible communication member may be deployed in the conventional so-called constant tension mode in which the deployed length is kept to a minimum by constantly deploying and withdrawing the member to maintain a constant tension therein.

However, the amplitude of vessel displacement and the rate of change of such displacement which can be accommodated by manoeuvring the flexible communication member in this way is limited by the length of member which can be deployed and withdrawn, the rate of such deployment and withdrawal and the power required or available to effect a practicable combination of both.

In an emergency situation as considered above in which an unpredictable or freak sea-state causes excessive vessel displacement, or rate of displacement, or in which the tension in the flexible communication member is increased rapidly by fouling with some other moving vessel or its equipment then the situation also arises where it is desirable to uncouple the flexible communication member in the controlled manner of the present invention.

Referring to FIG. 9 this is similar to the reel deployment apparatus shown in FIGS. 1 to 3, and like parts are given corresponding reference numerals. The apparatus is again described with the flexible communication member being a control umbilical. However, the Figure does illustrate the alternative direction of winding of the jumper 29, that is, in the same sense as umbilical 13. The apparatus also differs from that described above in that the normally-applied brake 23 is omitted and the motor 27', instead of being used for initially determining deployed length is designed to apply a continuous withdrawal or winding torque to the reel 20 which imparts a corresponding predetermined tension to the deployed umbilical 13 such that when equilibrium exists the reel becomes stationary. A decrease in umbilical tension, such as use to the vessel descending into a trough, unbalances the equilibrium and the driven reel withdraws the umbilical until the tension therein is restored. On the other hand an increase in umbilical tension overcomes the drive of the reel and pulls umbilical off the reel.

Clearly there is a limit to the length of umbilical which can be deployed in this way and to prevent damage to the umbilical and coupling equipment and the control means 25 includes transducer means 26' which responds to an umbilical tension in excess of the predetermined value having moved the support reel to a position at which a known additional length remains thereon to cause the control means to shut down the communication channels. From this point operation is as described above in relation to FIGS. 2 to 6 after the brake 23 thereof has been released. Similarly any of the forms of coupling means described may be employed.

Another form of constant tension device for an umbilical is shown in FIG. 10 which is similar to FIG. 8 in that the umbilical is suspended from a vertically reciprocable member such as a piston as shown or winched cabled hoist (not shown) the end of the umbilical being attached to the vessel system by way of cooperating coupling members 60, 61 held in cooperative relationship by engagement means 64 actuated by externally controlled actuators 65.

The piston 54 is located in a cylinder 53 is supplied with hydraulic fluid at a constant predetermined pressure sufficient to exert a tension on the umbilical equal to, or greater than, its weight such that the support rises and falls as the tension in the umbilical tries to vary with vessel motion. The system effectively dispenses with the brake formed by fluid lock developed through valve 57 and operates as described above after the release of such brake.

The amplitude of travel of the piston 54 and attached support 50 is limited in accordance with the normal vessel amplitudes, for instance between the raised position shown and the lower position shown ghosted at 50'.

A sensor 58 of the pressure of fluid in the cylinder determines when an excessive tension in the umbilical draws the support piston beyond its normal travel and the determination of such excessive travel is employed by the control means to shut down the communication channel in the umbilical. If desired, the sensor may also indicate a pressure in the cylinder consistent with the umbilical tension exceeding a preset higher level so that the control means 58 energises actuators 65 and the coupling members are uncoupled, releasing the umbilical to fall from the pulley of the support means.

It will be appreciated that the above described arrangement is open to modification, such as the travel of the support may be measured directly by displacement transducers, just as the release means may be made responsive to cable tension directly by frangible connection means as discussed above.

Furthermore, it will be be appreciated that the embodiments of rotatable support reel and of a reciprocable piston and cylinder are exemplary only and the techniques of the present inventions are applicable to corresponding reciprocable support devices such as spring loaded or winched pulley systems.

The various embodiments described above show the numerous variations possible within the scope of the invention. However it may be pointed out that some, namely those described with reference to FIGS. 8 to 10 require that a source of electrical and/or hydraulic power be available for their operation. The arrangement described in FIG. 2 to 6 wherein the reel is held stationary by a simple spring-loaded brake has the advantage that it can be made to operate in the event of a power interuption, determination of reel position and subsequent closing down of the umbilical services being performed purely mechanically as a function of movement of the reel by the withdrawing umbilical.

In all of the above described embodiments the mounting member of the mounting means has been shown carried by the umbilical separate from the coupling member to prevent umbilical tension from being transmitted to the junction between the two coupling members. It will be appreciated that the coupling member terminating the umbilical may be formed of suitably robust material for the mounting member to be secured to, or formed integrally with, the coupling means.

Also it is reiterated that although the above examples have described the flexible communication member as a control umbilical it may be any such flexible member along which a channel of communication is formed.

We claim:

1. A communication arrangement between a sub-sea structure and a floating vessel, comprising an elongate flexible communication member having at least one communication channel, deployment means on the vessel operable to deploy the flexible communication member by suspending it from support means movable with respect to the deployment means to determine the length of flexible member deployed, releasable coupling means arranged to couple each communication channel of the flexible communication member to a corresponding channel of a vessel communication system and control means responsive to a first predetermined level of tension in the suspended flexible communication member to deploy a further length of the member and during said deployment to inhibit communication between the channels of the vessel system and the channels of the flexible communication member and after said inhibition of communication between the channels and deployment of said further length of the member responsive to continuation of said tension in the flexible communication member of at least said first predetermined level after deployment of said further length of the member to uncouple the flexible communication member from the vessel system at said coupling means and release the flexible communication member from the deployment means.

2. A communication arrangement as claimed in claim 1 in which the control means includes braking means operable when set to maintain a constant deployed length of the flexible communication member and responsive to tension in the deployed flexible communication member greater than said first predetermined level to be released and permit a change in deployed length of the member.

3. A communication arrangement as claimed in claim 1 in which the control means includes transducer means responsive to movement of the support means during deployment of said further length of flexible communication member to cause said inhibition of communication between the channels of the vessel system and channels of the flexible communication member.

4. A communication arrangement as claimed in claim 3 in which the transducer means is operable to determine the position of the support means at which a predetermined portion of said further length of flexible communication member remains undeployed.

5. A communication arrangement as claimed in claim 1 in which the support means comprises a reel rotatably mounted at a fixed location on the vessel and upon which an undeployed length of the flexible communication member is wound.

6. A communication arrangement as claimed in claim 1 in which the coupling means comprises a pair of coupling members attached one each to the vessel system and to the flexible communication member to terminate each communication channel therein and to cooperate with each other to connect each said communication channel between the vessel system and the flexible communication member, mounting means including a communication mounting member, carried by the flexible communication member with its coupling member, and engagement means operable to releasably secure the mounting member to the deployment means to prevent transfer of tension from the flexible communication member to the coupling members until released.

7. A communication arrangement as claimed in claim 6, in which the engagement means is responsive to a second predetermined level of tension in said flexible communication member acting on the engagement means to cause the engagement means to release the mounting member from the deployment means, permitting the transfer of tension in the flexible communication member to the coupling members.

8. A communication arrangement as claimed in claim 7 in which said second predetermined level of tension to which said engagement means is responsive is greater than said first predetermined level to which the control means is responsive.

9. A communication arrangement as claimed in claim 8 in which the engagement means comprises at least one withdrawable member movable transversely to the direction of flexible member tension acting in the mounting member to engage the mounting member and deployment means and prevent motion between the deployment means and the mounting member in the direction of said tension, actuation means responsive to a level of said tension in excess of said second predetermined level to move each said withdrawable member to disengage the mounting member from the deployment means and permit said flexible member tension to be transmitted by way of the mounting member to the coupling member.

10. A communication arrangement as claimed in claim 8 in which the engagement means comprises at least one frangible connector extending between the mounting member and the deployment means, said frangible connector being arranged to resist force thereon due to tension in the flexible member greater than the first predetermined level but arranged to fracture in response to a flexible member tension at a second predetermined level higher than the first predetermined level to permit said tension to be transmitted by way of the mounting member to the coupling members.

11. A communication arrangement as claimed in claim 10 in which the frangible connector comprises at least one shear pin or bolt extending substantially transversely to the direction of flexible member tension acting in the mounting member.

12. A communication arrangement as claimed in claim 6 in which the engagement means is responsive to the position of the support means with respect to the deployment means after deployment of said further length of flexible member to cause release of the engagement means.

13. A communication arrangement as claimed in claim 12 in which the support means comprises a reel rotatably mounted at a fixed location on the vessel and upon which an undeployed length of the flexible communication member is wound and in which the engagement means comprises at least one substantially radially extending abutment surface formed on the reel and abutment means carried with the mounting member operable to abut against said abutment surface by the action of tension within the flexible elongate member acting tangentially of the reel preventing relative motion between the abutment surface and the abutment means circumferentially of the reel surface.

14. A communication arrangement as claimed in claim in which the abutment surface and abutment means comprise radially extending pin and recess one each disposed on the reel and mounting member such that the pin extends into the recess and abutment is effected between their lateral walls by said tangentially acting tension in the flexible elongate member.

15. A communication arrangement as claimed in claim 14 in which the pin is formed as part of the mounting member and the recess is formed in the surface of the reel of the support means.

16. A communication arrangement as claimed in claim 13 in which the abutment surface is formed by at least two shoulder members raised with respect to the reel surface and the abutment means comprises a toggle pin carried by the mounting member between said shoulder members and extending substantially longitudinally of the reel surface so as to bear against the shoulder members.

17. A communication arrangement as claimed in claim 16 in which the abutment surface is inclined away from the tangential direction in which the tension in the flexible elongate member acts to form a recess in which the toggle pin is retained by said tension such that as the flexible elongate member leaves the reel surface upon becoming fully unwound, a component of said tension acts on said pin to cause it to leave said recess.

18. A communication arrangements as claimed in claim 17 in which the mounting means includes a projection extending perpendicularly to the toggle pin and the mounting member producing a point of contact, and in response to the flexible elongate member leaving the reel surface, is caused to pivot about the point of contact of the toggle pin, such that the projection bears against the reel as a cam and causes the toggle pin to leave the abutment surface and disengage the mounting member from the reel.

19. A communication arrangement as claimed in claim 6 in which the coupling members are attached to each other by frangible connection means and the coupling member of the vessel system is connected to the deployment means by a stay member, said frangible connection means being arranged to fracture due to the application of flexible member tension, by way of the mounting member, at a level below said predetermined level at which the control means functions.

* * * * *

UNITED STATES PATENT AND TRADEMARK OFFICE

CERTIFICATE OF CORRECTION

PATENT NO. : 4,742,792

DATED : May 10, 1988

INVENTOR(S) : Mank et al

It is certified that error appears in the above-identified patent and that said Letters Patent is hereby corrected as shown below:

Claim 10, line 5, "force" should be -forces--.

Claim 14, line 2, after "claim" insert --13--.

Signed and Sealed this

Sixth Day of June, 1989

*Attest:*

*Attesting Officer*

DONALD J. QUIGG

*Commissioner of Patents and Trademarks*